United States Patent [19]

Conn et al.

[11] 3,939,046

[45] Feb. 17, 1976

[54] METHOD OF ELECTROFORMING ON A METAL SUBSTRATE

[75] Inventors: Gordon A. Conn, Verona; William R. Gass, Pittsburgh, both of Pa.

[73] Assignee: Westinghouse Electric Corporation, Pittsburgh, Pa.

[22] Filed: Apr. 29, 1975

[21] Appl. No.: 572,813

[52] U.S. Cl. ..... 204/4; 204/9; 204/33; 204/141.5

[51] Int. Cl.[2].... C25D 1/00; C25D 1/02; C25D 5/44

[58] Field of Search ..... 204/3, 4, 9, 12, 141.5, 204/33, 129.75

[56] References Cited

UNITED STATES PATENTS

| | | | |
|---|---|---|---|
| 880,484 | 2/1908 | Edison | 204/13 |
| 1,515,658 | 11/1924 | Cole | 204/141.5 |
| 2,433,441 | 12/1947 | Davidoff | 204/13 |
| 3,326,782 | 6/1967 | Kendrick et al. | 204/3 |
| 3,627,654 | 12/1971 | Petit et al. | 204/141.5 |

*Primary Examiner*—T. M. Tufariello
*Attorney, Agent, or Firm*—D. P. Cillo

[57] ABSTRACT

A metal article is produced by: (1) providing an aluminum master substrate, the surface of which may be smooth or patterned; (2) making the aluminum master substrate cathodic, in an acid or acid salt solution which will not etch aluminum, at a current density of between about 10 to 500A/sq. ft., at solution temperatures of up to about 50°C; (3) coating the surface of the aluminum master substrate with a thin metal layer and (4) dissolving the aluminum master substrate, to provide a metal foil article that is a negative duplicate of the smooth or patterned aluminum master substrate surface.

10 Claims, 5 Drawing Figures

METHOD OF ELECTROFORMING ON A METAL SUBSTRATE

BACKGROUND OF THE INVENTION

Extremely thin, patterned or irregular shaped metallic foils are difficult to fabricate by conventional manufacturing techniques. Patterns can be pressed into metal foil using a metal embossing cylinder, but such methods are often not suitable for extremely fine detailed patterns.

Plating thin metal coatings on aluminum substrates is one method of making thin wall shapes. Most plating processes, such as that taught by Coll-Palagos in U.S. Pat. No. 3,726,771, require removal of the oxide on the aluminum, for example by a HF dip, and then metal deposition under conditions that prevent reoxidation of the aluminum substrate surface. In such a process, the deoxidizing can easily destroy the original finish and detailed pattern or grain of the metal substrate. The pattern on the electroformed foil will be fuzzy and lack fine detail. Cleaning processes, such as a simple room temperature nitric acid dip followed by application of zinc petrolatum compound, as taught by Bonwitt in U.S. Pat. No. 2,437,220, while cleaning without removing all the oxide, do not provide a particularly suitable electro-deposition surface.

Cooke et al, in U.S. Pat. No. 3,718,547, teaches a continuous process for selectively removing magnesium oxide from a magnesium containing aluminum substrate, and then reforming an anodic oxide film by alternating current electrical treatment in sulfuric acid at 90°C, prior to lacquering. Such initial oxide removal could easily destroy the original finish at many points on the surface.

Bailey et al, in U.S. Pat. No. 3,844,906, rather than remove the aluminum oxide layer from a cylindrical mandrel, plates chromium over it and polishes the chromium, prior to electroforming a nickel coating from a nickel sulfamate bath at 200 to 500 A/sq. ft. This process generates high bath temperatures requiring cooling, and involves the expense of chromium plating and polishing, which plating would not conform to any fine detail present on the mandrel.

What is needed then, is a method of manufacturing thin metal foil which can successfully reproduce an extremely fine detailed pattern or mirror finish on the foil, from a specially treated patterned, embossing plate or mandrel having a surface conducive to metal electro-coating.

SUMMARY OF THE INVENTION

This invention solves the above problem by electroforming a metal foil upon the natural oxide of a dissolvable, patterned, smooth and/or mirror finished master substrate, preferably a tubular or cup shaped metal mandrel. The critical part of the method is the electrochemical cleaning of the mandrel prior to electroforming.

In the method of this invention: (1) an aluminum master substrate is provided, having a patterned, grained, smooth and/or mirror finish which is desired to be reproduced; the surface being covered with an oxidized layer; (2) optionally, oils and organic matter are removed by a suitable solvent; (3) the master substrate is made cathodic (negative) in an acid or acid salt solution which will not etch the aluminum beneath the oxide layer. A current density of between about 10A/sq. ft. to about 500A/sq. ft. is applied at solution temperatures of up to about 50°C, to cause evolution of hydrogen gas upon the master substrate surface. This combination electrochemical and mechanical process cleans the surface without removing all of the natural oxide layer at any point on the surface, or destroying the original surface finish or any fine detail of the pattern, yet "electro-chemically activates" the surface to prepare it for later metal deposition; (4) the treated master substrate is coated with a thin metal layer, preferably by electroforming in a suitable metallic solution, at a current density and for a time effective to plate the surface of the master substrate; (5) the support substrate is then dissolved, preferably by a suitable alkali hydroxide solution and (6) optionally, any impurities or residue remaining on the patterned metal plating are removed by ultrasonic techniques or by a suitable acid or acid salt solution.

This method provides a metal foil article between about 0.2 mil to 50 mils thick, which is a negative duplicate of the master substrate and which can have faithfully transferred thereto the smooth finish or all of the fine detailed pattern from the master substrate.

BRIEF DESCRIPTION OF THE DRAWINGS

For a better understanding of the invention, reference may be made to the preferred embodiments, exemplary of the invention, shown in the accompanying drawings, in which.

DESCRIPTION OF THE PREFERRED EMBODIMENTS

Figure 1:
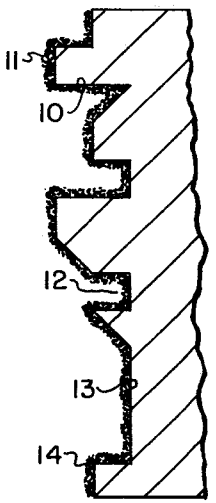
FIG. 1 shows, in magnified cross section, a patterned master substrate, with a mirror smooth finish between the protuberances and indentations forming the pattern.

Referring now to FIG. 1 of the drawings, a master substrate, having at least one finished surface which is desired to be reproduced, is shown as 10. In the method of this invention, the master substrate will be aluminum. The aluminum may contain about ½–5 wt.% copper or other metals, to improve machining properties. The master substrate can have a pattern of proturberances 11 and indentations 12, as well as a smooth or mirror finished surface 13. Generally the surface will be smooth. The pattern can be impressed by engraving or by a metal embossing cylinder and can be of extremely fine detail. A smooth surface can be achieved by sanding and a polished mirror finished surface can be impressed by a suitable die. The finished surface will be covered by a natural oxidized layer 14.

The thickness of the master substrate can range from about 0.001 inch to 0.25 inch (0.0025–0.62 cm.). It would be difficult to handle or pattern master substrates having a thickness less than about 0.001 inch, and difficult to dissolve the aluminum mandrel in a commercially feasible time at thicknesses greater than about 0.25 inch. The master aluminum substrate can be flat, cylindrical, cup shaped with a hollow closed end or of an irregular configuration having grooves, slots and the like.

Figure 2:
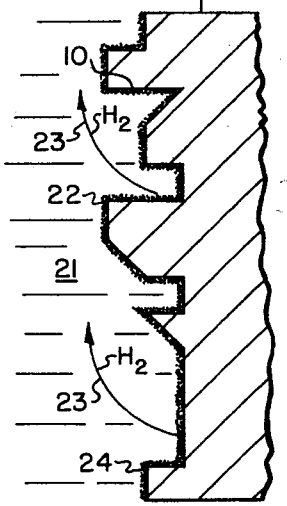
FIG. 2 shows, in magnified cross section, the master substrate made cathode in acid or acid salt solution, with hydrogen gas evolution at the master substrate surface during the electro-cleaning step of this process.

FIG. 2 shows the master substrate in acid or acid salt electro-cleaning solution 21. The solution 21 will generally be a bath in a container and must be maintained at a temperature below about 50°C. At higher temperatures the solution will easily allow the temperature at the solution-master substrate surface interface 22 to become high enough for the acid or acid salt solution to etch the aluminum master substrate surface.

The master substrate 10 is connected to the negative terminal of a power supply, and made cathodic in the solution 21 at a current density of between about 10A/sq. ft. to about 500 A/sq. ft., preferably 10–12-0A/sq. ft. i.e., amps per square foot of master substrate surface area to be cleaned and plated (107–5,400 A/sq. meter).

At current densities above 500A/sq. ft., the acid or acid salt solution 21 will completely dissolve the oxidized layer at points along the surface and attack and etch the aluminum surface, causing loss of pattern definition and possibly ruining the surface finish. Over about 120A/sq. ft., for prolonged time periods, may generate heat sufficient to cause the acid to start etching the aluminum. At current densities below about 10A/sq. ft, no hydrogen will be formed, possibly due to reduction reactions in which hydrogen is not a by-product.

These current density ranges are critical in providing hydrogen gas 23 evolution, from the oxidized, finished surface interface 22, effective to clean the aluminum surface without causing chemical or electrochemical attack of the aluminum surface by the solution 21. The master substrate cannot be made anodic, or the solution may etch the base aluminum surface. The anode may be a carbon, platinum, or other suitable material not attacked annodically by the acid or acid salt solution.

Only certain mineral, carboxylic, hydroxy, and dicarboxylic acids and acid salts can be used as the solution 21 in the electro-cleaning step of this process. These acids should be relatively soluble in water so that the solution will have good conductivity, i.e., their solubility should be at least about 9g/100g $H_2O$ at 20°C. These acid and acid salts should not etch aluminum, i.e., they should not chemically attack the aluminum surface to make it soluble in the solution or cause the solid to change to an ionized phase in solution, a drastic form of which would be complete dissolution. However, the term etch as used herein should not be considered an absolute term. The electro-cleaning solution should not substantially deteriorate the surface finish of the aluminum within the current densities and time periods herein set forth.

Suitable electro-cleaning materials would include solutions of nitric acid, acetic acid, citric acid, oxalic acid, formic acid, propionic acid, butyric acid, tartaric acid, malic acid, glyceric acid, lactic acid, glycolic acid, malonic acid, maleic acid and their sodium or potassium salts i.e., sodium nitrate, potassium nitrate, sodium acetate, potassium acetate, sodium citrate, potassium citrate, sodium oxalate and potassium oxalate, etc, and mixtures thereof.

Sulfuric, hydrochloric, phosphoric and hydrofluoric acid solutions will generally attack and etch the aluminum surface and are not suitable as an electro-cleaning material in this process, i.e., they will randomly break through the oxide layer and at least start to dissolve or degrade the base aluminum. The preferred electro-cleaning solution is 2 wt. percent to 70 wt. percent nitric acid ($HNO_3$) in water, which provides very effective "electrochemical activation " without complete oxide removal. Depending on the current density, the cathodic aluminum surface will be cleaned effectively after about 10 seconds to 1200 seconds treatment (20 minutes) in the electro-cleaning solution, generally up to 600 seconds is sufficient.

In the electro-cleaning step, oil and grease remaining in the aluminum oxide matrix, on the surface of the aluminum substrate, are dissolved and oxide agglomerates mechanically removed or displaced by $H_2$ gas evolution. The surface is "electrochemically activated", i.e., the aluminum oxide layer remains, but is thinned out to provide a uniformly thick, relatively smooth oxide layer 24 without large agglomerates, which closely conforms to the finish on the master substrate. This uniformly thick aluminum oxide layer has a uniform resistance which will allow even, pin hole free nickel electrodeposition. In this step the aluminum oxide layer remains, no other ions being substituted for the aluminum.

Prior to electro-cleaning in solution 21, an initial degreasing step may optionally be used. This can be accomplished by dipping the master substrate in a suitable solvent which effectively removes oil and organic matter. Suitable solvents would include methyl alcohol, ethyl alcohol, propyl alcohol, butyl alcohol and the like, ketones such as acetone, methyl ethyl ketone and the like, trichloroethylene, perchlorethylene and the like. A 10 second to 120 second dip will generally be effective for cleaning and should be followed by air drying.

Figure 3:
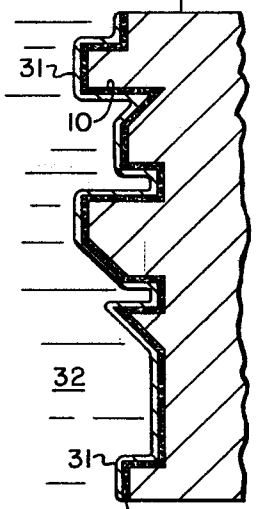
FIG. 3 shows, in magnified cross section, the master substrate made cathode in a metallic solution with a metal coating layer forming thereon.

The cleaned and activated aluminum master substrate is next placed in a metallic solution bath and made cathodic, as shown in FIG. 3. The master substrate 10 is connected to the negative terminal of a power supply. A DC potential is applied at a predetermined current density and for a time effective to deposit a metal layer 31, which coats the surface of the master substrate. The current density range is a function of the individual plating system. Effective current densities will range between about 5A/sq. ft. to about 150A/sq. ft. of surface area to be plated. Processing difficulties start to occur in this system at over about 150A/sq. ft.

The anode may be a nonconsumable carbon electrode or one that will replenish metal ions to the bath such as nickel when nickel is to be plated. The anode can be in bar, plate, mesh or chip form. When a nickel anode is used it may contain a small proportion of sulfur, about 0.02% to 0.04%, to promote dissolution. At about 20A/sq. ft, the metal layer will be deposited at a rate of about 0.001 inch per hour. Pinhole free metal layers can be coated to thicknesses of between about 0.0002 inch to about 0.050 inch (0.000005–0.00125 mm.) over a time period of about ½ hour to 50 hours.

The metal layer can be applied by suitable spraying techniques, but an electroforming technique from a metallic solution 32 is preferred. The solution should be maintained at a temperature of between about 20°C to about 85°C depending on the metallic solution used.

Suitable metal coating materials must be compatible with aluminum, yet not attacked by the alkali hydroxide or other solution used to dissolve the master substrate. Suitable metal coating materials would include solutions of nickel sulfamate, nickel sulfate, gold cyanide, silver cyanide, copper cyanide, copper sulfate, copper fluoroborate, tin sulfate, cadmium cyanide, cadmium fluoroborate, cobalt sulfate, cobalt sulfamate, platinum sulfamate, and the like to provide nickel, gold, silver, copper, tin, cadmium, cobalt or platinum foil.

The preferred metal coating materials are solutions selected from nickel sulfamate or nickel sulfate, which have a pH of between about 2 to 5. The nickel bath temperature should range between about 35°C to about 65°C. Hydrolysis of the nickel solution bath can occur at temperatures over about 65°C.

The characteristics and operating conditions of the nickel solution bath and the others that can be used are well known in the plating art. For example, suitable nickel sulfamate baths could contain a buffer such as boric acid, present in amounts ranging from 10g/liter to saturation in addition to between about 200 to 700g/liter of nickel sulphamate. A typical nickel electrocoating bath would contain about 300g/liter of nickel sulfamate (about 55g/liter of nickel ion); about 40 g/liter of boric acid and the balance water operated at a pH of about 4.

Chloride or bromide ion, in amounts up to about 25g/liter, may be present, generally as nickel chloride or nickel bromide, to increase anode dissolution. The bath may also contain up to about 1g/liter of a wetting agent such as sodium lauryl sulfate or sodium lauryl sulfoacetate, which provides effective surface tension properties in the bath for superior plating. The usual impurities known to be harmful in nickel plating, such as zinc, chromium and lead should be controlled to low levels. When electrocoating from gold, silver, copper, tin, cadmium, cobalt or platinum baths suitable adjustments known to those in the art can be made regarding the amount of buffer if any to be added.

Figure 4:
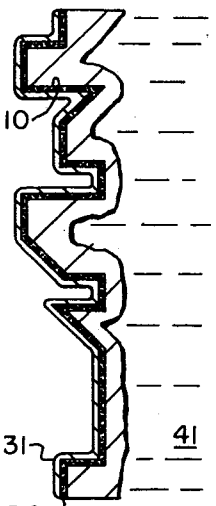
FIG. 4 shows, in magnified cross section, the master substrate being dissolved by an alkali hydroxide solution.
Figure 5:
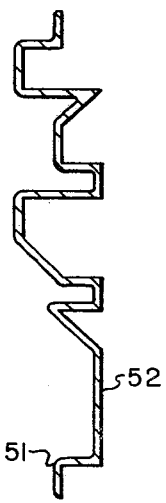
FIG. 5 shows, in magnified cross section, the formed metal foil sheet, which is a negative duplicate of the master substrate.

Referring now to FIG. 4, an alkali hydroxide or other suitable solution 41 known to dissolve aluminum and its oxides is applied to the aluminum master substrate 10, for a time effective to dissolve the master substrate 10 and its thinned adherent oxidized coating 24, leaving the metal foil sheet, shown as 51 in FIG. 5. The aluminum dissolving solution should be maintained at a temperature of between about 20°C to about 85°C. Generally the coated master substrate will be placed in a bath of the dissolving solution for a time period of about 2 hours to about 6 hours depending on the thickness of the aluminum substrate. The preferred dissolving solutions are 10 wt. percent to 50 wt. percent sodium hydroxide or potassium hydroxide in water. Selected acid solutions may be used to dissolve the aluminum master substrate but they must not attack the metal coating 31.

After dissolution of the aluminum master substrate, some copper impurities from the aluminum may be attached to the metal foil sheet 51 at the surface 52. Most other impurities do not seem to present this problem. These impurities are in the form of a single atomic layer of atoms and as small amounts of microscopic agglomerates. These impurities may be removed by ultrasonic techniques using water or by applying an acid or acid salt which will not attack the primary metal of the metal foil sheet. Suitable materials for this selective etching step would include solutions of nitric acid, mixtures of nitric acid and sulfuric acid, sodium cyanide, potassium cyanide and the like. For a nickel foil sheet, a 5 second to 20 second dip in 1.5 wt. percent to 45 wt. percent nitric acid ($HNO_3$) in water at between about 25°C to 35°C is preferred.

The resulting metal foil, shown in FIG. 5, is between about 0.0002 inch to 0.050 inch thick and a negative duplicate of the master aluminum substrate. It can be flat, cylindrical, cup shaped or of highly irregular configuration. It will have exactly reproduced the surface finish on the master substrate. The finished foil article will be pinhole free, structurally strong and ductile. This method is particularly useful in making crack free, theoretically dense, thin-wall nickel cups of varying diameters which can be concentrically stacked and used in vacuum multi-foil insulation applications. The following non-limiting example is illustrative of the metal foils that can be formed using this method.

EXAMPLE 1

A high-density, thin wall nickel cup, having a smooth interior, was fabricated by an electroforming technique using a nickel sulfamate plating bath and a polished, specially cleaned and "electrochemically activated" aluminum mandrel substrate.

The aluminum mandrel substrate was made of 2024 aluminum which contained about 96 wt. percent aluminum and about 4 wt. percent copper. The mandrel had a hollow 8 inch (20.3 cm.) long cup shape, with a 1.0 inch (2.54 cm.) outside diameter and a ⅛ inch (0.32 cm.) wall thickness. The closed outside end of the cup shaped mandrel was machined to a ⅛ inch radius so that it would have smooth corners. The outside of the mandrel was polished to a No. 6 surface finish, i.e. a smooth finish, where the distance between adjacent microscopic ridges and valleys on the surface is about 0.000006 inch. The aluminum cup shaped mandrel was cleaned by dipping it in room temperature trichloroethylene, rinsing it off in room temperature acetone and then letting it drip dry.

The cup shaped aluminum mandrel was then placed in a tank containing 14 wt. percent aqueous $HNO_3$ solution. The mandrel was made cathodic at 60A/sq. ft. of outside cup surface, by connecting it to a direct current power supply. The anode was a platinum mesh. The bath temperature was 25°C and the cleaning-"activating" time was 60 seconds.

During this electrocleaning-activating step, hydrogen gas was evolved at the mandrel surface-solution interface. The hydrogen gas scrubbed the surface clean of any residual polishing compound and other surface debris including aluminum oxide agglomerates. The nitric acid slowly reacted with the aluminum oxide layer on the aluminum base mandrel, thinning it out, and making it a uniform thickness with a smooth surface, but not removing it. The aluminum base surface of the mandrel was not etched, attacked or degraded in any way. The smooth, uniform agglomerate free oxide surface provides an "activated" surface for electroforming, since the oxide resistance is uniform. This will result in very smooth, even, pinhole free subsequent metal coating.

The cleaned-activated, cup shaped, aluminum mandrel was rinsed and air dried. It was then placed, closed bottom side down, so that the solution only contacted the outside walls, in a tank containing nickel sulfamate metal plating solution. The solution contained about 300 g of nickel sulfamate/liter of water and about 40 g of boric acid/liter of water, operated at a pH of about 4. The mandrel was made cathodic at a current density of 20A/sq. ft. of outside cup surface, by connecting it to a direct current power supply. The anode was a 95 wt. percent pure nickel bar containing an effective small amount of sulfur to help electrode dissolution and replenishment of nickel ions in the bath. The bath temperature was 50°C and the plating time was 120 minutes. During this metal coating step nickel was deposited on the outside surface of the cup as a layer about 0.002 inch (0.005 cm.) thick.

The nickel plated, hollow, cup shaped aluminum mandrel was then placed in a tank containing 150g NaOH/liter of water, i.e., 15 wt. percent, at 90°C. After about 3 hours the aluminum mandrel and its attached oxide layer was dissolved, leaving a thin metal foil cup. It appeared that some copper from the mandrel coated the interior of the nickel cup. To eliminate the copper, the cup was rinsed, drip dried and placed in a tank containing an aqueous mixture of 14 wt. percent nitric acid and 53 wt. percent sulfuric acid, at 25°C for about 10 seconds. This solution dissolved the copper deposits but did not etch or attack the nickel surface.

The finished nickel cup had a bright interior surface finish with a low porosity. The finish was similar to that on the polished surface of the aluminum cup used as the dissolvable mandrel. Microscopic examination at 400 power revealed no pitting. The open end of the free standing cup could be repeatedly flexed without permanent deformation or work hardening.

A second cup was made as described above except for activating in 5 wt. percent aqueous $HNO_3$ solution, for 180 seconds and nickel plating for 30 minutes at 20A/sq. ft. of outside cup surface. A cup having a wall thickness of 0.0005 inch was obtained, having a bright, very smooth interior surface finish with no pitting.

Other electro-cleaning acids have been used to electrochemically activate 2024 aluminum mandrels having a No. 6 surface finish, using the same procedures followed above. Acetic acid was used at 15 wt. percent concentration for 10 minutes at 35A/sq. ft.; citric acid was used at 10 wt. percent concentration for 10 minutes at 50A/sq. ft.; oxalic acid was used at 10 wt. percent concentration for 4 minutes at 120A/sq. ft.; formic acid was used a 10 wt. percent concentration for 10 minutes at 63A/sq. ft. In all cases a platinum mesh anode was used with a bath temperature of 25°C. During these electrocleaning-"activating" experiments, evolved hydrogen gas scrubbed the aluminum mandrel surfaces and the acids provided a uniform oxide thickness without etching or degrading the mandrel. The cleaned-"activated" cup shaped mandrels were then rinsed, air dried and coated with 0.0005 inch thick nickel from a nickel sulfamate bath similar to that described above, using a 30 minute plating time. The plating was smooth and pinhole free.

The inside of a cup shaped aluminum mandrel could also be electro-plated using this process. Similarly, flat aluminum substrates, having a smooth or patterned surface could be coated using this process. For example, the non-patterned side of a flat mandrel could be covered, prior to introduction into the plating bath, with a film of material, such as petroleum jelly, which would provide a non-plateable surface. This material could then be removed prior to dissolution of the mandrel. After the mandrel is dissolved, a sheet of thin, smooth or patterned nickel, gold, platinum, silver, copper, tin, cadmium or cobalt foil would remain. Such foil could be used in jewelry and many other applications.

Cups made by the method described above have provided the only solution for producing vacuum multi-foil concentric cup thermal insulation in a completely implantable nuclear powered artificial heart. This fabrication technique provides ultra dense, ultra thin, ultra smooth cups, utilized to eliminate high heat loss areas such as mitred corner joints.

We claim:

1. A method of making a metal article comprising the steps of:

1. providing an aluminum master substrate having at least one surface which is desired to be reproduced, said surface being covered with an oxidized layer;
2. making the aluminum master substrate cathodic at a current density of between about 10A/sq. ft. to about 500A/sq. ft., in an aqueous electrically conducting solution selected from the group consisting of an acid solution or acid salt solution or mixtures thereof which will not etch aluminum, said solution having a temperature of up to about 50°C, said current causing evolution of gas at the solution-oxidized surface interface and chemical activation effective to thin and smooth the oxidized layer without removing it;
3. coating the smoothed, oxidized surface of the aluminum master substrate with a thin metal layer; and
4. dissolving the aluminum master substrate and the attached oxidized layer, to provide a metal article having a surface that is the negative duplicate of the surface of the master substrate.

2. The method of claim 1 wherein the metal layer coated in step *3) is selected from the group consisting of nickel, gold, platinum, silver, copper, tin, cadmium and cobalt, the aluminum master substrate is dissolved in an aqueous alkali hydroxide solution and the acid or acid salt of the electrically conducting aqueous solution in step (2) has a solubility of up to 9g/100g $H_2O$.

3. The method of claim 1 wherein the aqueous, electrically conducting solution in step (2) is selected from the group consisting of nitric acid, acetic acid, citric acid, oxalic acid, formic acid, propionic acid, butyric acid, tartaric acid, malic acid, glyceric acid, lactic acid, glycolic acid, malonic acid, maleic acid and their sodium and potassium salts and mixtures thereof and the current density is applied in step (2) for about 10–1200 seconds.

4. The method of claim 1 including cleaning the master substrate between steps (1) and (2) in a suitable solvent to remove oil and organic matter.

5. The method of claim 2 wherein the master substrate is between about 0.001 inch and 0.25 inch thick and is coated by making the master substrate cathodic at a current density of between about 5A/sq. ft. to about 150A/sq. ft. for a time effective to deposit a metal layer about 0.0002 inch to 0.050 inch thick.

6. The method of claim 5 wherein the metal layer coated in step (3) is nickel and as a last step the nickel article is cleaned in a suitable material effective to etch copper but not nickel.

7. A method of making a nickel article comprising the steps of:

1. providing an aluminum master substrate having a thickness of between about 0.001 inch to 0.25 inch and at least one surface which is desired to be reproduced, said surface being covered with a nickel oxide layer;

2. making the aluminum master substrate cathodic at a current density of between about 10A/sq. ft. to about 120A/sq. ft., in aqueous 2 wt. percent to 70 wt. percent nitric acid solution, said solution having a temperature of up to about 50°C, said current causing evolution of gas at the solution-nickel oxide coated surface interface and chemical activation effective to thin and smooth the nickel oxide layer without removing it;

3. electrocoating the smoothed, nickel oxide coated surface of the aluminum master substrate by making the master substrate cathodic at a current density of between about 5A/sq. ft. to about 150A/sq. ft. in a bath containing a solution selected from the group consisting of nickel sulfamate and nickel sulfate solution for at time effective to deposit a nickel layer about 0.0002 inch to 0.050 inch thick;

4. dissolving the aluminum master substrate and the attached nickel oxide layer in an aqueous alkali hydroxide solution to provide a metal article having a surface that is the negative duplicate of the surface of the master substrate.

8. The method of claim 7 including cleaning the master substrate between step (1) and (2) in a suitable solvent to remove oil and organic matter.

9. The method of claim 7 wherein the current density is applied in step (2) for about 10–1200 seconds, and as a last step the nickel article is cleaned in 1.5 wt. percent to 45 wt. percent nitric acid at between about 25°C to about 35°C.

10. The method of claim 7 wherein the aluminum master substrate is cup shaped and the nickel article is cup shaped.

* * * * *